US005911323A

United States Patent [19]

Bapst

[11] Patent Number: 5,911,323

[45] Date of Patent: Jun. 15, 1999

[54] PACKAGING AND METHOD FOR TRANSPORTING OXYGEN GENERATORS

[75] Inventor: Frederick H. Bapst, Hamburg, N.Y.

[73] Assignee: Figgie International Inc., Mayfield Heights, Ohio

[21] Appl. No.: 09/074,884

[22] Filed: May 8, 1998

Related U.S. Application Data

[60] Provisional application No. 60/046,025, May 9, 1997, and provisional application No. 60/061,258, Oct. 3, 1997.

[51] Int. Cl.[6] ..... B65D 85/20

[52] U.S. Cl. ..... 206/446; 229/120; 229/120.37

[58] Field of Search ..... 206/0.6, 3, 446, 206/524.4; 229/120, 120.37

[56] References Cited

U.S. PATENT DOCUMENTS

| | | | |
|---|---|---|---|
| 1,008,963 | 11/1911 | Ekermeyer . | |
| 2,301,233 | 11/1942 | Wark | 206/3 |
| 2,371,271 | 3/1945 | Smith | 206/3 |
| 2,692,077 | 10/1954 | Kuhlman | 229/14 |
| 2,801,742 | 8/1957 | Farrell | 206/65 |
| 3,331,550 | 7/1967 | Krzyzanowski | 229/87 |
| 3,510,376 | 5/1970 | Freire et al. | 206/3 |
| 3,731,585 | 5/1973 | Demberg et al. | 206/3 |
| 3,757,933 | 9/1973 | Banta | 206/3 |
| 4,022,343 | 5/1977 | Richardson | 220/3 |
| 4,134,497 | 1/1979 | Dlugopolski | 206/521 |
| 4,222,484 | 9/1980 | Howe | 206/3 |
| 4,248,342 | 2/1981 | King et al. | 206/3 |
| 4,286,708 | 9/1981 | Porzel | 206/3 |
| 4,823,956 | 4/1989 | Belisle | 206/523 |
| 5,133,258 | 7/1992 | Rock et al. | 102/331 |
| 5,407,077 | 4/1995 | Sinclair, Sr. | 206/586 |

FOREIGN PATENT DOCUMENTS

WO9503521 2/1995 WIPO .

*Primary Examiner*—Jim Foster

*Attorney, Agent, or Firm*—Hodgson, Russ, Andrews, Woods & Goodyear, LLP

[57] ABSTRACT

Packaging and method for transporting one or more gas generators. The gas generator is separated and insulated from walls of a sub-compartment. Side walls of the sub-compartment have apertures for passing heat and gas from the sub-compartment for dissipation thereof within a container in which the sub-compartment is contained. Passages are allowed in the container during closing thereof for release of heat and gas thereof.

20 Claims, 10 Drawing Sheets

PACKAGING AND METHOD FOR TRANSPORTING OXYGEN GENERATORS

Priority is hereby claimed of co-pending U.S. Provisional applications Ser. No. 60/046,025, filed May 9, 1997, and Ser. No. 60/061,258, filed Oct. 3, 1997, which are hereby incorporated herein by reference.

The present invention relates generally to packaging for transporting oxygen generators, and may also be suitable for transporting other types of gas generators (which is meant to include, for the purposes of this specification and the claims, containers having the chemical contents which may react to give off heat as well as oxygen generators).

Various safety precautions are taken to prevent actuation of oxygen generators during shipment. However, in the event that an oxygen generator were to prematurely actuate, fire and the actuation of other oxygen generators packaged therewith (sympathetic actuation) are of concern.

U.S. Pat. No. 2,301,233 discloses the packaging of a plurality of gas generating cartridges in a container subdivided into compartments by separators, and protective end caps are placed over the igniter ends. The container and separators are composed of metal or other flame-resisting material. According to the patent, even if ignition takes place, the fire is confined to one cartridge.

U.S. Pat. No. 3,757,933 discloses the packaging of a plurality of explosive units within a wooden or a plastic box having a plurality of housing tubes, formed of chipboard, composition board, multi-layers of Kraftpaper, etc., for receiving the units respectively. According to this patent, these tubes, in the event of premature detonation, enable the explosive forces to be largely isolated to their longitudinal components. Sides of the box proximate to the open ends of the housing tubes have partially punched out areas so as to blow out upon the occurrence of a premature detonation and thereby prevent a build-up of explosive gases that might cause sympathetic detonation.

Other patents which contain suggestions for preventing sympathetic detonation or which may otherwise be of interest include U.S. Pat. Nos. 2,371,271; 2,692,077; 4,022,343; 4,134,497; 4,222,484; and 4,133,258.

Oxygen generators have been transported in cardboard boxes wherein cardboard tubes have been formed about the oxygen generators, and a plurality of the cardboard tubes containing oxygen generators are tightly packed within the box.

A rule, proposed by the International Civil Aviation Organization (ICAO), includes a requirement that shipping containers for oxygen generators be constructed so that if, despite the safety devices incorporated in the generator, the generator should actuate inside the package, the package will not burst into flame, will not cause any other generators in the package to initiate, and the surface temperature of the shipping container will not exceed 100 degrees C. at any time after activation.

When oxygen generators are initiated, an exothemic decomposition of the sodium chlorate contained inside the generator releases large amounts of essentially pure oxygen. Because the reaction in the generator after initiation is exothemic, a very large amount of heat is also produced by a generator during operation.

The amount of heat produced by a single generator can cause the surface of the generator to exceed 500 degrees F. during normal operation. In normal operation, the generator is mounted in such a way as to allow air flow over the generator to carry off the heat produced, and the oxygen produced by the oxygen generator is carried off by means of tubing attached to the outlet of the generator and used to supply a mask in support of human respiration. However, operation of a generator in a confined environment such as inside a conventional shipping package such as described above may trap the heat developed, causing the generator to reach even higher than normal temperatures, and the oxygen may also be trapped in the vicinity of the hot generator since there is no tubing or mask connected to the generator during shipping to carry off the oxygen.

Thus, if an oxygen generator should, despite all the precautions taken to prevent unintended initiation, accidentally initiate during shipment, the result could be a high concentration of oxygen in contact with a very hot generator. Moreover, as the concentration of oxygen increases, the ignition temperatures of the packaging and generator materials decreases. Under such circumstances an ignition of the packaging material and/or the materials of construction of the generator itself is undesirably a possibility.

Accordingly, it is an object of the present invention to package oxygen generators for shipment in such a way that, should a generator actuate inside the package despite the safety devices incorporated in the generator, local concentrations of heat and oxygen do not build up inside the package.

It is another object of the present invention to package the oxygen generators using inexpensive common packaging materials such as cardboard or fiberboard (both defined as "cardboard" for the purposes of the claims) packaging materials and a minimum of refractory materials.

In order to prevent localized build-ups of heat and oxygen in the event that a generator actuates inside the container despite the safety devices incorporated in the generator, in accordance with the present invention, one or more (such as 12) sub-containers or sub-compartments for containing the generators are disposed within the container. The container is selected to be large enough to adequately disperse the heat and oxygen so that local heat and oxygen build-up are prevented. Cylindrical heat-resistant (insulative) end caps or other suitable means are provided on each end portion of the generator to thereby separate and insulate the generators from the sub-container walls. The end caps are captured by sub-container projections or by packers or by other suitable means, thereby "floating" the oxygen generators within their sub-containers respectively. Heat and oxygen are thus allowed to flow longitudinally along the oxygen generators and beyond the end caps since the cylindrical end caps are contained within generally square (in cross section) sub-containers. Perforations are provided in walls of the sub-containers to allow free passage of heat and oxygen between a sub-container and the other sub-containers (or alternatively into a space or gap around the sub-container) to allow for dissipation of oxygen throughout the container and to prevent a local build-up of heat and oxygen. When the container is closed, the closure flaps are not completely taped along their side edges to leave routes for escape of generated heat and oxygen from the container.

The above and other objects, features, and advantages of the present invention will be apparent in the following detailed description of a preferred embodiment thereof when read in conjunction with the accompanying drawings wherein the same reference numerals denote the same or similar parts throughout the several views.

DETAILED DESCRIPTION OF THE PREFERRED EMBODIMENT

Figure 1:
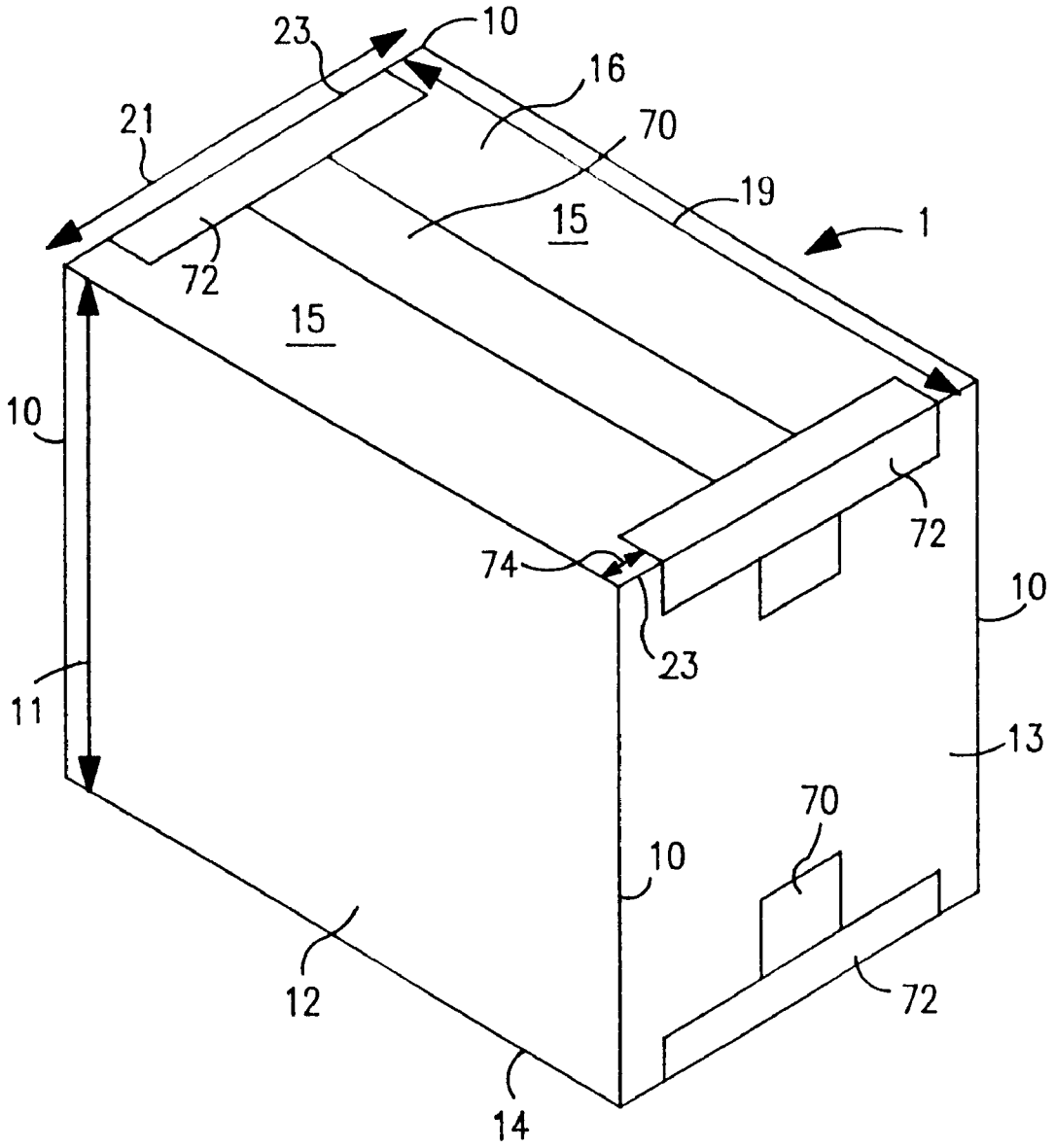
FIG. 1 is a perspective view of a container, illustrated closed and taped for shipment, which embodies the present invention.
Figure 2:
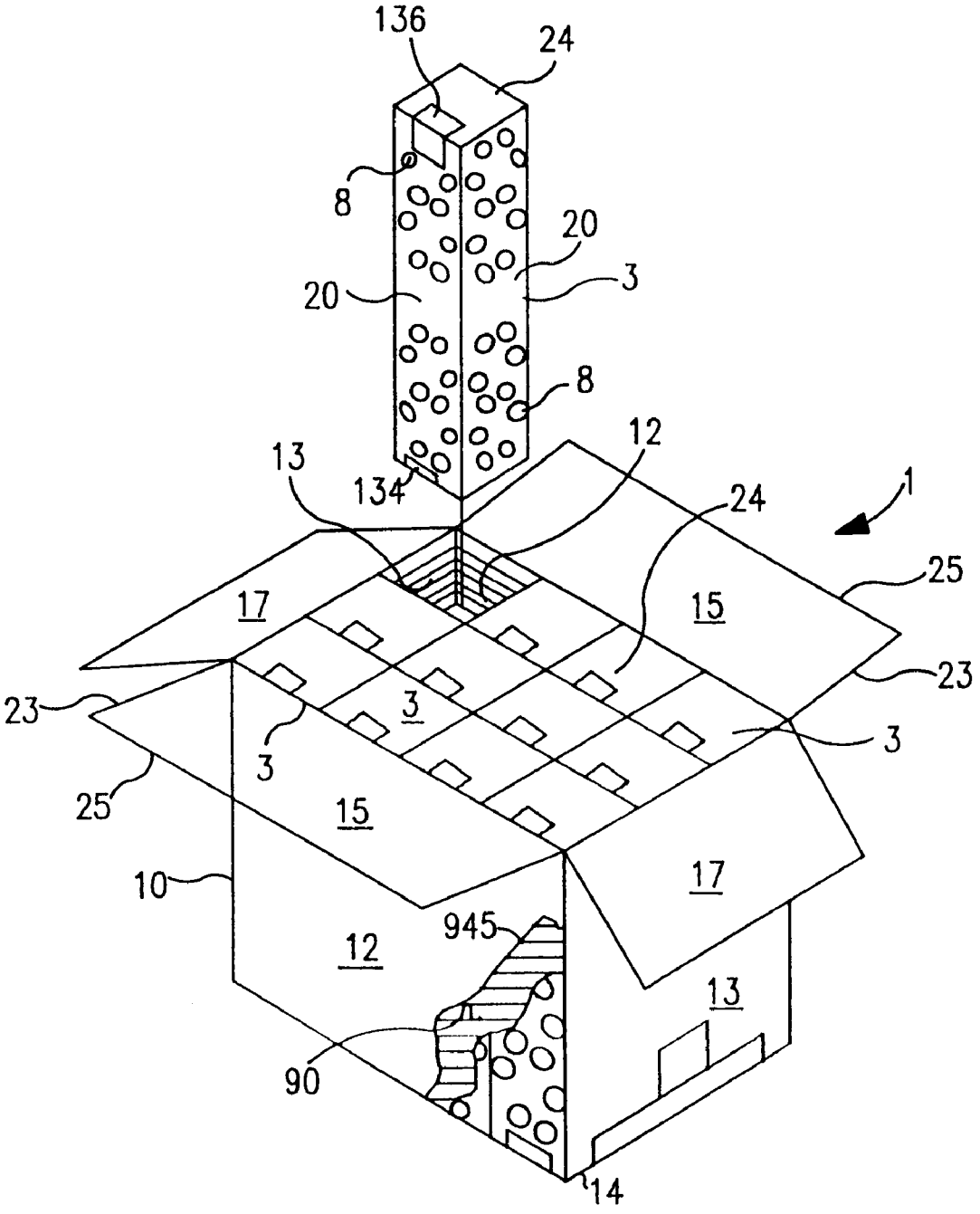
FIG. 2 is a perspective view of the container opened and illustrating an arrangement of oxygen generator sub-containers packed therein, with one of the sub-containers removed therefrom for ease of illustration, in accordance with the present invention.

Referring to FIGS. 1 and 2, there is shown generally at 1 a shipping container which may be a box formed of corrugated cardboard or fiberboard (for example, 275 lb. Test BC flute) and having two side walls 12, two end walls 13, a bottom wall 14, and an upper wall 16. The box 1 is conventionally formed of a blank (not shown). It should therefore be understood that, along the lines indicated at 10, the outer side and end walls 12 and 13 are foldably joined. The upper wall 16 conventionally comprises flaps 15 and 17 hingedly (foldably) connected to the side and end walls 12 and 13 respectively to permit opening and closing of the box in a manner which is commonly known. The bottom wall 14 similarly has flaps (not shown) which are foldably connected to the side walls 12 and which are folded and taped to form the bottom wall, as is conventionally known. The cardboard container 1, which is advantageously of light weight as well as inexpensive so that it may be disposed of after use, is shown to contain a plurality of solid state chemical oxygen generators, illustrated at 4 in FIG. 3.

The oxygen generators 4 are typically round or cylindrical and have the size generally of a medium vacuum or thermos bottle. However, they may be of any other suitable shape and size. The shipping container 1 should be large enough to allow heat and oxygen produced by an initiated generator to be suitably dispersed to thereby avoid local concentrations of high heat and high oxygen. The minimum volume of the container 1 is accordingly related to the amount of oxygen produced by a single generator, the duration of time that the generator operates to produce oxygen, and the maximum temperature thereof while producing oxygen. For example, for a typical oxygen generator which produces approximately 100 liters of oxygen over a period of 15 minutes at a surface temperature of 500 degrees F., the container 1 may have a height, length, and width, illustrated at 11, 19, and 21 respectively in FIG. 1, of perhaps about 15, 16, and 12 inches respectively to produce a volume of perhaps about 2880 cubic inches for handling 100 to 130 liters of oxygen released over 15 minutes. As seen in FIG. 2, the container 1 is of a size to contain 12 oxygen generators 4. However, the shipping container 1 may be otherwise suitably sized. Sizes and shapes of packaging materials will vary depending on the sizes and shapes of the generators being packaged. Thus, unless otherwise stated, all dimensions provided in this specification are for exemplary purposes only and not for purposes of limitation.

The shipping container 1 is suitably closed for shipping with the end flaps 17 folded to underlie the side flaps 15 and are therefore not seen in FIG. 1. The closure flaps 15 of the upper wall 16 are not completely taped to the respective end walls 13 along their side edges 23, or other suitable means are provided, to leave relief passages for generated heat and oxygen to escape from the container 1 when the generated gas pressure begins to build up in the container. Thus, for example, as illustrated in FIG. 1, a strip 70 of suitable tape such as, for example, non-asphaltic reinforced gum tape is applied over the adjacent edges 25 of the opposed outer side flaps 15 and partially along the corresponding end walls 13. Strips 72 of suitable tape, which may be similar to tape 70, are also applied along the side edges 23 of these side flaps 15 but terminating short of each of the ends thereof by a distance, illustrated at 74, of at least about 1 inch to provide gaps for such relief. The container bottom wall 14 may be similarly taped. Alternatively, glue or staples or other suitable means, instead of tape 70 and 72, may be provided to close the container provided a complete gas-tight seal is not achieved.

Figure 3:
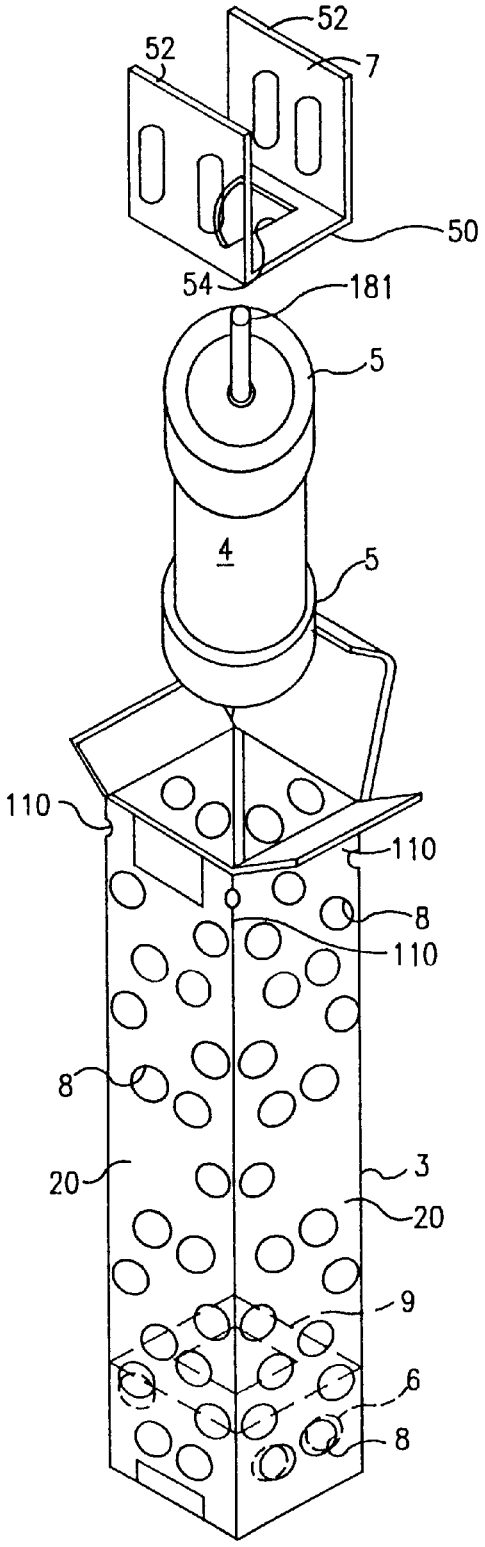
FIG. 3 is a perspective view of the sub-container and illustrating an oxygen generator being placed therein.
Figure 14:
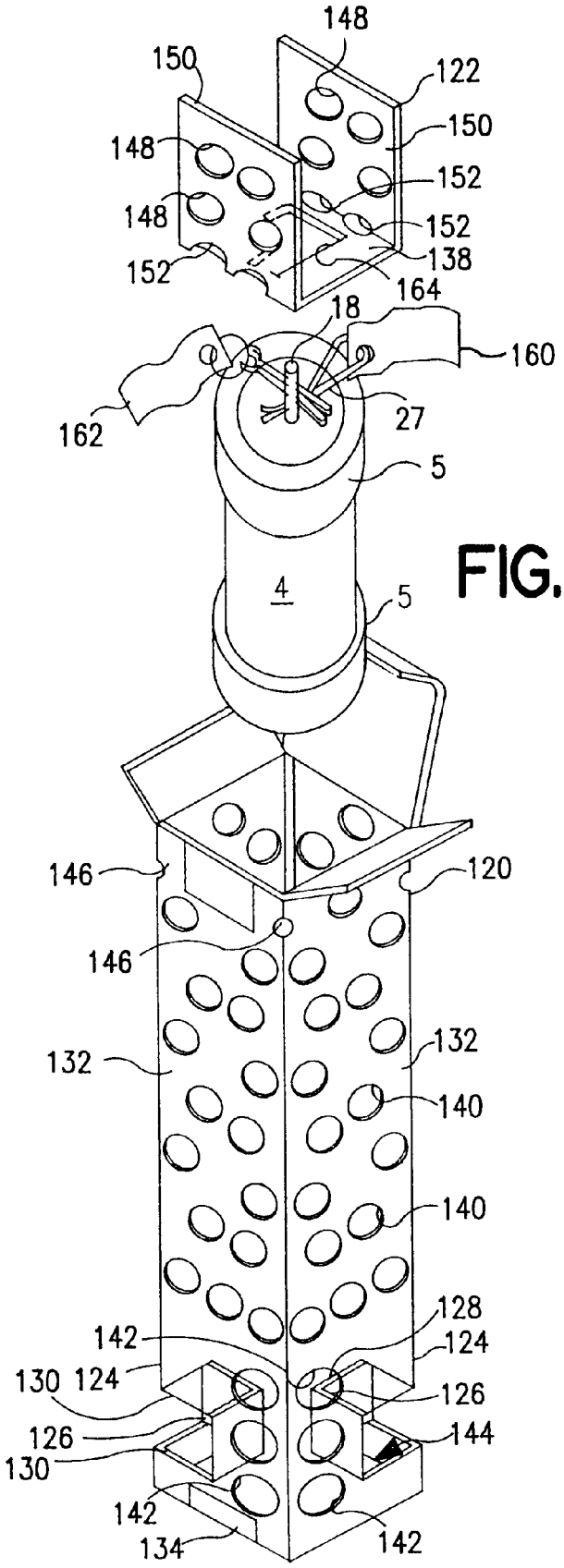
FIG. 14 is a view similar to that of FIG. 3 of the sub-container for the embodiment of FIG. 13 and illustrating an oxygen generator being placed therein.
Figure 15:
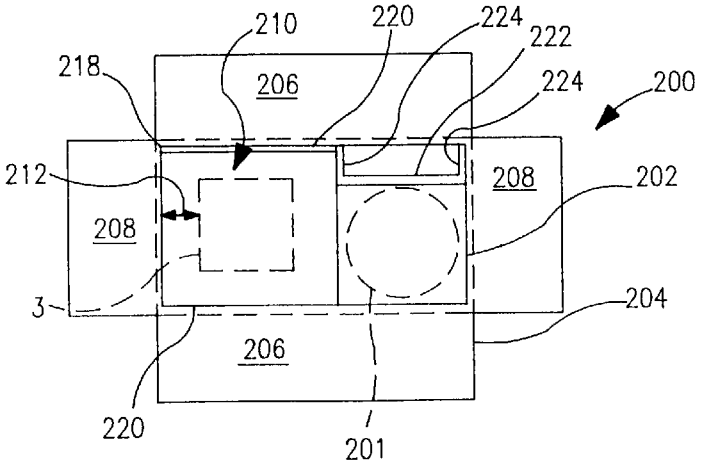
FIG. 15 is a plan view of a container opened and illustrating an arrangement of packaging for an oxygen generator and its storage housing in accordance with an alternative embodiment of the present invention.

The generators 4 are compositely packaged in individual corrugated cardboard sub-containers or sub-compartments 3 within the shipping container 1, the sub-containers being oriented vertically so that the generators 4 may be placed therein to be oriented vertically with the actuation pins, illustrated at 18 in FIG. 14, facing upwardly. The total of sub-containers 3 in the container is referred to in the claims as "sub-compartment means", and the space within a sub-container for receiving a gas generator is referred to in the claims as a "sub-compartment". For example, the sub-containers 3 may all be of equal size which is such that they are snugly contained within the shipping container 1. In FIG. 3, the actuation pin is not shown but is illustrated capped conventionally with a protective cap 181 to prevent ignition. FIG. 14 illustrates other conventional measures (not illustrated in FIG. 3) taken to prevent the generators 4 from firing during shipment including a safety pin 27. One or more of the generators could alternatively be oriented, when packed, with the actuation pins 18 facing downwardly.

The sub-containers 3, which may be composed, for example, of 200 lb. test BC flute or other suitably corrugated board, are shown to be square in horizontal cross-section.

The corrugations, illustrated at 40, extend vertically for the desired strength vertically. The width of each side wall 20 thereof is greater than the generator diameter so that the generator 4 does not contact the sub-container 3, as discussed in greater detail hereinafter. This also allows heat and oxygen to pass freely along the length of the generator 4. Each sub-container 3 is shown to have a bottom closure flap 22 and an upper closure flap 24 and a couple of inner flaps 42 for each of the upper and lower closure flaps.

The generators, when initiated, can get hot enough to ignite cardboard. In order to prevent contact between each generator 4 and its sub-container 3 so that it is not ignited by a hot generator, a circular or doughnut-shaped protective end cap 5 is mounted onto each end portion of each generator so that each end cap projects beyond the respective generator body end. Each end cap 5 is sized to have a loose sliding fit with the respective generator end portion, wherein the degree of movement between parts is minimized, i,e, just tight enought to prevent vibrational damage. Each end cap 5 is sized to have a diameter equal substantially to the width of a side wall 20 of the sub-container 3 so that the two end caps 5 also have a loose sliding fit within the sub-container 3. The various components are held together by the compressed force when the container 1 is closed. The end caps 5, which may be used only for shipment and then disposed of, are suitably made of a castable ceramic fiber or other suitable refractory material or the like having a very high resistance to heat flow through it as well as an extremely high resistance to ignition, even in oxygen enriched atmospheres while still being resilient enough (non-brittle) to sufficiently resist shock loads from vibration. An example of a suitable material for the end caps is a castable ceramic fiber material marketed by Exochem Corp. of Lorraine, Ohio.

Since the end caps 5 are circular and the sub-containers 3 are square in section, the resulting spaces therebetween allow heat and oxygen to freely flow beyond the end caps so that they may freely flow over the entire length of the sub-container to aid in preventing local concentrations of heat and oxygen.

Figure 6:
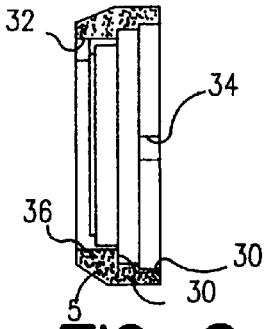
FIG. 6 is a sectional view taken along lines 6—6 of FIG. 5.
Figure 5:
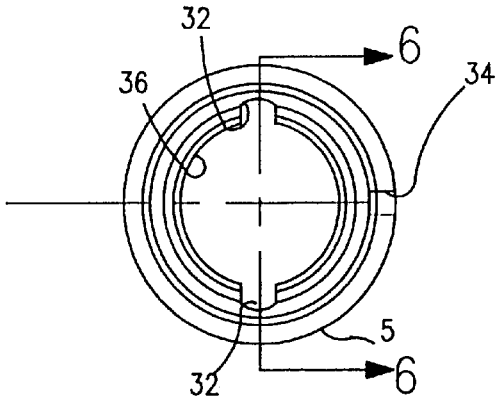
FIG. 5 is an end view of a protective end cap for the oxygen generators.
Figure 7:
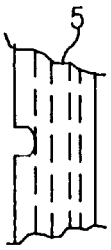
FIG. 7 is a partial view of the end cap of FIG. 5.

Referring to FIGS. 5 to 7, end cap 5 has a centrally-disposed opening, illustrated at 36, extending axially entirely therethrough. The opening or inner surface 36 of each end cap 5 preferably has a pair (or more) of steps, illustrated at 30, providing a pair of different diameters so as to fit generators having different diameters, the generator being fit in the step 30 which is sized for it with a loose sliding fit which minimizes movement therebetween. As seen in FIG. 6, this also minimizes contact between the end cap and the generator to allow heat to be convected from the generator surface to thereby reduce local hot spots on the generator surface. For accommodating mechanical projections on the generators, a pair of diametrically-opposite slots, illustrated at 32, are shown in the inner surface 36 on the outer end portion (opposite the portion containing the steps 30) of the end cap, and a slot, illustrated at 34, is shown in the outer surface on the inner end portion of the end cap. Two or more end caps may be provided each having, for example, three steps so that together the two end caps provide steps of six different diameters to accommodate six different generator diameters. During packing, the end cap having the corresponding diameter step for the generator being shipped would be used. The end caps may be otherwise suitably shaped for the particular shape of generators to be shipped therewith.

In order to suspend the generators vertically within the container 1 so that their end portions do not engage the container or sub-containers, the generators are held by suitable means such as, in accordance with the embodiment of FIGS. 1 to 11, upper and lower corrugated cardboard packer members 7 and 9 respectively. Each upper packer member 7 is folded to be generally U-shaped, i.e., it has a generally square bottom wall 50 and a pair of side walls 52 which are hingedly (foldably) connected thereto and extend upwardly therefrom. The bottom wall 50 is sized so that its edges loosely engage the sides 20 of the sub-container 3, and it is disposed to engage the upper surface of the upper end cap 5. Since the upper surface of the generator body is recessed from the upper surface of the upper end cap 5, the packer member 7 does not contact the generator body 4. A suitable cut-out or opening 54 is provided in the bottom wall 50 for the protruding actuator pin 18 or for other generator protrusions as needed. The width of each side wall 52 is substantially equal to the width of the corresponding sub-container side wall 20, and the height of each side wall 52 is selected so that it extends from the bottom wall 50 to the top of the sub-container where it is restrained by upper lid 24 from movement upwardly, thereby restraining the upper end cap 5 and the oxygen generator 4 from movement upwardly.

Figure 8:
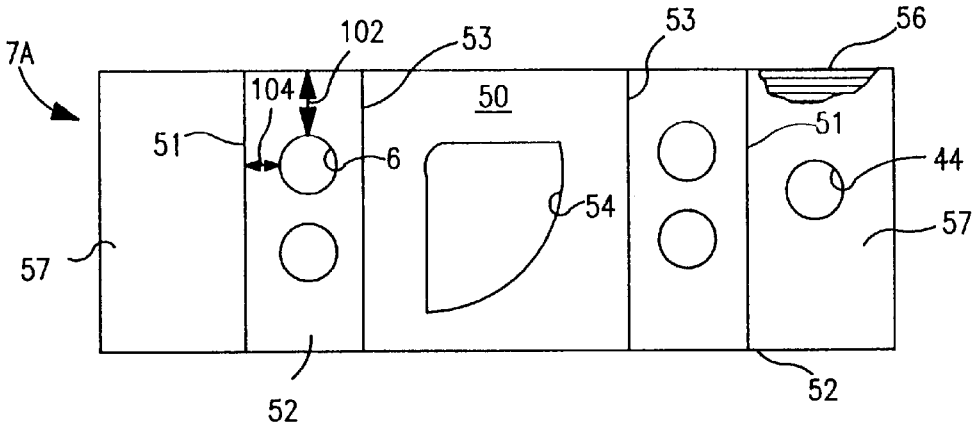
FIGS. 8, 9, and 10 are plan views of blanks for a set of upper packers for the sub-container use with different sizes and configurations of the oxygen generators respectively.
Figure 9:
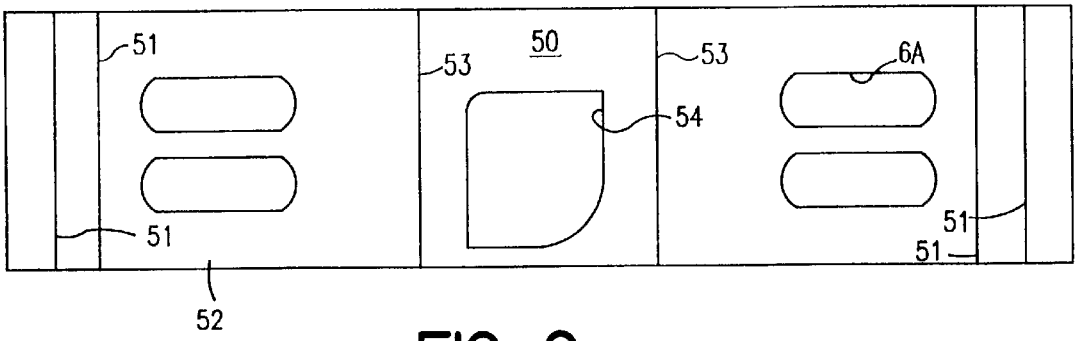
Figure 10:
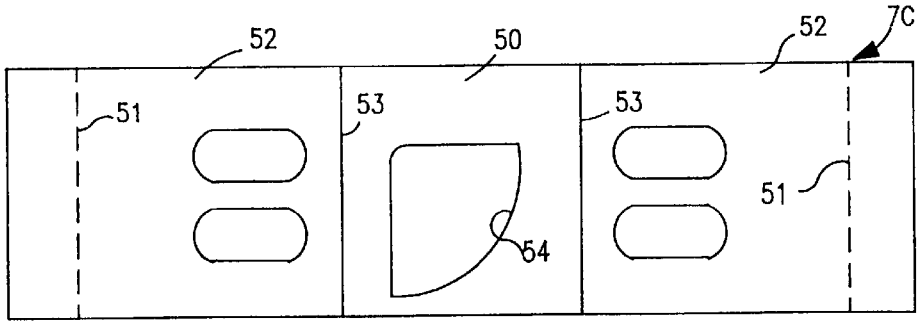

In order to accommodate various generator lengths, a set of upper packers, illustrated at 7A, 7B, and 7C in FIGS. 8, 9, and 10 respectively are provided, and, during packing, the suitable upper packer for the generator being packed is selected and used. In order that a single upper packer 7 may accommodate more than one generator length, each of its side walls 52 is scored (such as by 0.25 inch long perforations spaced 0.25 inch apart) along one or more lines, illustrated at 51, which are parallel to the bottom wall 50 (or fold line 53 between the bottom and side wall respectively), the fold lines 51 on one side wall 52 being equally distant from respective fold line 53 as fold lines 51 on the other side wall 52 are from their respective fold line 53. When the packer is folded along a set of score lines, the outer or terminal portions 57 thereof are positioned to be parallel to the bottom wall 50 and closely underlie the sub-container lid 24. FIGS. 8 and 10 illustrate one fold line 51 in each side wall 52 for packers 7A and 7B, while FIG. 9 illustrates two fold lines 51 in each side wall 52 for packer 7B. A packer may of course have more than two fold lines 51 in each side wall 52 thereof, or it may have no fold lines in its side walls 52. The material of which the packers is made is suitably strong enough for supporting the packer walls even with the score lines therein. The packer material may, for example, be 275 lb. Test B flute corrugated board. The packer member 7 is formed so that the corrugations, illustrated at 56 in FIG. 8, extend vertically in the side walls 52 to maximize strength thereof.

Figure 11:
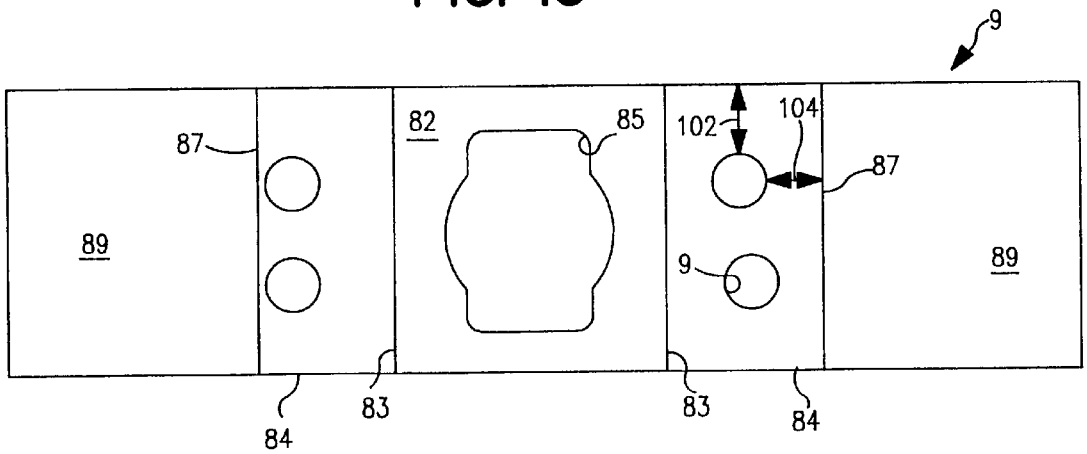
FIG. 11 is a plan view of a blank for a bottom packer for the sub-container.

Referring to FIG. 11, lower packer member 9 has an upper wall 82 for engaging the lower end cap 5 and a pair of side walls 84 foldably connected thereto along parallel score lines 83 to extend downwardly therefrom to engage the bottom wall 14 of the container 1. This packer member 9 is similar to packer member 7 except that its cut-out 85 is differentally shaped to accommodate a generator bottom. It has one score line 87 on each side wall 84 for adjusting the side wall height, the outer portions 89 lying on the container bottom wall 14 when the packer 9 is folded along score lines 87 for use. Thus, a single lower packer 9 is provided, and a selection of upper packer members which have different side wall heights are provided so that for each generator length different size upper packer members are selected. If desired, a selection of lower packer members may be provided in addition to or instead of a selection of upper packer members. For example, lower packer 9, modified as necessary including ventilation holes, may also be used as an upper packer for increased shock resistance.

The packers may be constructed so that they can also serve to retain warning tags, lanyards, or other flammable components, which are sometimes required to be attached to the generators, out of contact with the surfaces of the generators so as to prevent ignition of these accessory components in the event a generator should inadvertently actuate. Thus, when the packer 122 in FIG. 14 is placed in position over upper end cap 5, the warning and shipping tags 160 and 162 respectively are received in packer opening 164 to thereby lie out of contact with the generator.

Figure 12:
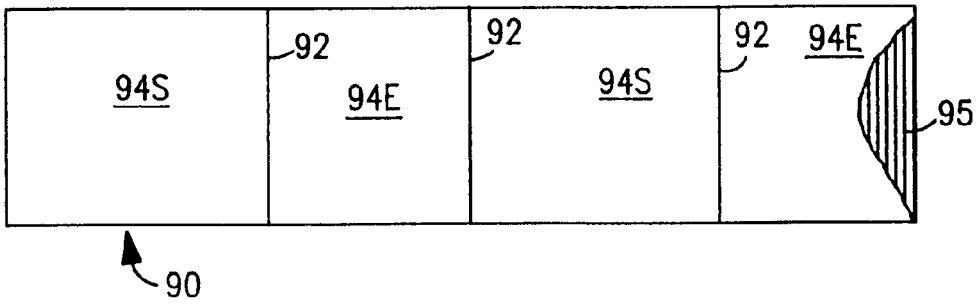
FIG. 12 is a plan view for a liner for a container which embodiments the present invention.

The flaps 15 and 17 provide a double layer or thickness to each of the upper and lower walls 16 and 14 respectively. In order to provide double thickness to the side and end walls 12 and 13 respectively so that they may have similar strength (whereby the desired container strength may be achieved with a minimum amount of corrugated board), a suitable corrugated board liner, illustrated at 90 in FIG. 12, composed of perhaps 275 lb. Test BC flute corrugated board, is provided as a blank to be foldable along lines 92 to provide four walls 94S and 94E for being disposed alongside side and end walls 12 and 13 respectively. The outer walls 94 seen in FIG. 12 may be similarly foldably joined to each other. The corrugations 95 thereof are shown to extend vertically to provide the desired strength vertically.

Figure 4:
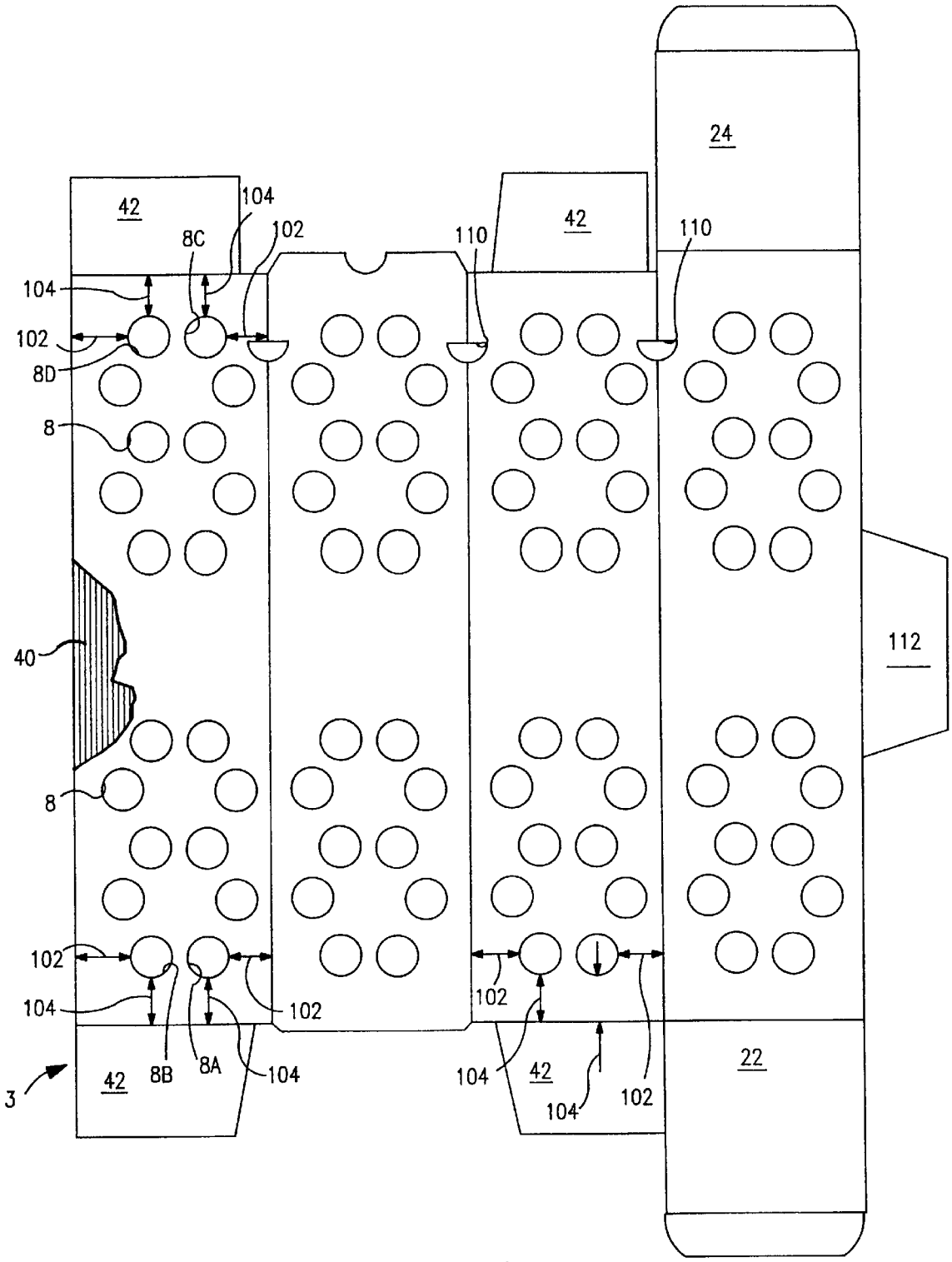
FIG. 4 is a plan view of a blank for the sub-container.

As previously discussed, it is considered desirable to avoid local concentrations of heat and oxygen in the event of premature initiation of an oxygen generator so as to prevent or reduce the possibility of ignition of the packaging material and/or materials of construction of the generator. In order to disperse the heat and oxygen throughout the space within the container 1 so as to avoid such local concentrations, in accordance with the present invention, a plurality of perforations or holes, illustrated at 8, which may each have a diameter of, for example, 0.75 inch, are provided in the side walls 20 of the sub-container 3. The holes 8 are arranged so that at least some holes in a wall 20 of a sub-container at least partially align with holes in a facing wall of another sub-container to allow ready passage of gas and heat between any one sub-container 3 and the other sub-containers 3 in the container 1 to thereby allow for the dissipation of oxygen and heat throughout the container 1 and reduce a local build-up of oxygen and heat. Thus, it is considered desirable that all four sides 20 contain the holes 8. The holes 8 in the sub-containers 3 are thus desirably arranged so that no matter how the sub-containers are loaded into the outer container 1, there are always open unimpeded passages for hot gas to circulate through all of the sub-containers 3. Thus, the holes are suitably arranged in regular patterns, such as illustrated in FIG. 4, so that they are in the same relative positions to the edges of the sub-containers and same corresponding heights so that they will at least partially align no matter which sub-container walls are placed adjacent each other. The holes may also be arranged to provide at least some such alignment even if a sub-container is packed upside-down. The size and positioning of the holes are tailored to the particular characteristics of the generators and corrugated board used. For example, a greater number of holes may be provided at the hot or initiation ends of the generators. The holes 8 are preferably positioned so that a pair of holes 8A and 8B on opposite sides of each sub-container wall 20 and near the top and another pair of holes 8C and 8D on opposite sides of each sub-container wall 20 near the bottom are spaced equal distances, illustrated at 102 in FIG. 4, from the respective sides of the respective wall 20 and are spaced equal distances, illustrated at 104, from the respective end (top or bottom), and this symmetrical pattern (both vertically and horizontally) is repeated for the other holes 8 in the sub-container for an overall symmetrical pattern vertically and horizontally throughout all four walls 20 of the sub-container. Thus, with such a symmetrical arrangement of the holes 8, the holes in adjacent walls 20 of adjacent sub-containers 3 should "match" or line-up for flow communication through holes 8 in adjacent sub-containers no matter how the sub-containers are arranged in the container 1, even with some sub-containers upside-down. By providing such flow communication between all of the sub-containers, all of the volume (less space taken up by the generators and packaging) is available for dissipation of heat so that excess heat may be dissipated more effectively. It should be noted that the holes 8 may be arranged in any of various arrangements to achieve the desired symmetrical effect and may have any suitable sizes or shapes.

The packer members 7 also have holes or perforations 6 in each of their side walls 52 which are similarly arranged symmetrically both vertically and horizontally with holes 8 to "match" or align with holes 8 in the respective facing wall 20 of the sub-container 3 to similarly provide for the free movement of heat and oxygen. As seen at 6A in FIGS. 9 and 10, the holes may be vertically oblong so that they match holes 8 at more than one height to which the packer is adjusted.

It should be noted that the particular arrangement of holes and other features of the sub-containers 3 and packers 7 and 9 will vary to take into account the particular sizes and shapes and constructions of the generators 4. For example, two holes 8 are not contained in the upper end of one of the walls (the wall opposite the wall to which flap 24 is attached) of the sub-container 3 in order to provide room for application of tamper seal 136, tamper seals 134 and 136 being provided at the lower and upper ends respectively to give proof that the sub-container has not been opened since the generator was packaged therein. For another example, hole 44 is provided in portion 57 of packer 7A for receiving a lanyard from the generator so that the potentially flammable lanyard will be restrained by the packer away from the surface of the generator.

Notches, illustrated at 110 in FIG. 4 but not illustrated in FIGS. 2 and 3 for ease of illustration, are provided in the upper portions of the corners between sub-container walls 20 to insure ventilation at the top, i.e., to insure at least one gas exit path at the top for ventilation when a sub-container is placed in a corner of the shipping container no matter which side walls 20 are positioned to face the container sides. There will naturally be an opening in the corner between the walls 20 that are connected such as by stapling or gluing the tab 112 on one wall to another wall to form the sub-container from the blank shown in FIG. 4. To further stabilize the container, upper and lower tabs in addition to tab 112 may be provided for connecting the one wall to the other wall. If desired, notches may similarly be provided at the bottom of the sub-container.

Figure 13:
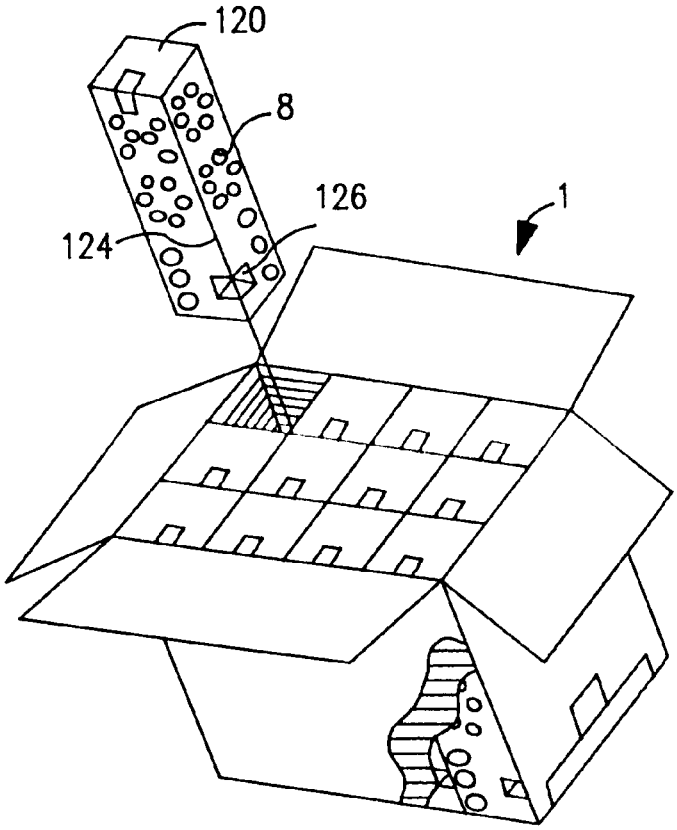
FIG. 13 is a view similar to that of FIG. 2 of an alternative embodiment of the present invention.

Referring to FIGS. 13 and 14, there is illustrated an alternative embodiment of the present invention wherein a sub-container 120 is received along with other similar sub-containers 120 in container 1 similarly as described with reference to FIGS. 1 to 12. A packer 122, similar to packers 7, is provided in the upper end of the sub-container 120 to hold the generator 4 securely spaced from the upper end. In accordance with this embodiment, a pair of lower tabs 126 are formed in diametrically opposed corners or edges 124 of the sub-container 120. The tabs 126 are spaced from the closed bottom sub-container wall, and their upper edges 128 are positioned at the desired height for resting of the lower end cap 5 thereon. Each tab 126 is formed by a pair of upper and lower parallel horizontal slits 130 cut through the respective long vertical edge 124 and extending through a distance of, for example, about 1.25 inch into each of the adjacent side walls 132 of the sub-container. To support the generator weight, the tabs should have a minimum height of, for example, about 1.25 inch. When the sub-container 120 is assembled, the sections of the corners between the slits 130 are manually pushed inwardly to form the tabs 126 which extend inwardly of the sub-container to provide the lower shelf 128 on which the lower end cap rests, the generator being packed so that the lower and upper end caps lie between and are restrainedly engaged by the tabs 126 and the packer 122 respectively. If desired, two or more pairs of such tabs at different heights (one pair in one pair of corners and another pair in the other pair of corners) may be provided to accommodate generators of different lengths. Thus, the end caps on the generator may be said to be "captured" between the tabs or projections 126 cantilevering into the sub-container and the bottom wall 138 of packer 122 thereby "floating" the oxygen generator in the center (vertically) of the sub-container, and the end caps maintain the generator spaced from the sub-container side walls. This arrangement is thus provided to advantageously prevent the generator from directly contacting any of the cardboard packaging material. If desired, the upper packer 122 may also be replaced by tabs similar to tabs 126. Even where both upper and lower tabs are provided in the sub-containers, packer members may still optionally be used to, for example, locate generators which are not of the length for which the tabs are provided and/or to retain potentially flammable accessories out of contact with the surfaces of the generators. In order to prevent crushing of the tabs 126 if the sub-container with the oxygen generator is dropped, the tabs 126 may be formed to extend entirely to the bottom of the sub-container or a spacer or packer member placed underneath the tabs for additional support. In order to prevent vibration from causing the tabs to cut into the end caps, a spacer or packer member may be placed between the end caps and the tabs.

Sub-container 120 has a plurality of holes 140 in each of its walls 132 in a pattern which should be noted is different from the pattern of holes in sub-container 3 but which are seen to be arranged to provide the desired horizontal symmetry so that there is flow communication between the holes no matter which walls 132 of adjacent sub-containers 120 face each other. It can also be seen that the hole pattern cannot be entirely symmetric vertically due to the tabs 126. In order to assure flow communication at the upper and lower ends should a sub-container be inserted upside-down, a series of vertically spaced increased diameter holes 142 are provided in each wall 132 to assure some alignment for flow communication with holes 140 at the upper end of an adjacent sub-container. It should also be noted that flow is also provided through openings, illustrated at 144, provided by the tab cut-outs 130 to further assure flow communication with holes 140 at the upper end of an adjacent sub-container should a sub-container be inserted upside-down. Sub-containers 120 have cut-outs, illustrated at 146, in corners thereof at their upper ends which are similar to cut-outs 110. Packer 122, in addition to having a pattern of holes, illustrated at 148, in its vertical walls 150, has a pair of spaced cut-outs, illustrated at 152, in the corners between the bottom wall 138 and each of its vertical walls 150 to further assure flow communication in the upper end of the sub-containers 120.

While the container 1 is shown to contain 12 sub-containers at least one of which contains a gas generator 4, it should be understood that, in accordance with the present invention, the container 1 may be sized to contain any number of sub-containers more than one. As discussed hereinafter, a single sub-container may also be suitably packaged in accordance with the present invention.

Individual sub-containers are preferably provided for the convenience of keeping the generators protectively therein after they have arrived at their destination until use thereof and so that generators of different sizes and shapes can be shipped in the same shipping container by choosing the appropriate sub-container for each generator. It should, however, be understood that, in accordance with the present invention, the generators need not be packaged in individual sub-containers as long as the generators are suitably isolated from flammable packing and accessories and as long as there is suitable ventilation through the space of the container in which two or more of the generators are contained. For example, the space within a shipping container may be subdivided into individual compartments for containing individual generators by criss-crossing flat sheets in the manner of an egg carton, with suitable holes therein for ventilation. The term "sub-compartment means", as used herein and in the claims, is meant to include such an egg carton embodiment as well as the plurality of individual sub-containers. It is also within the scope of the present invention to provide separate containers for groups of the sub-containers which separate containers are all receivable in a larger shipping container in a modular configuration wherein groups of generators are readily separable to be shipped separately.

The materials of which the shipping container and sub-containers are made may be any other suitable material than as described, for example, chip board, plywood, solid fiber board, or any other common packaging material.

In order to pack the plurality of oxygen generators for shipment, a protective end cap 5 is installed on each end portion of each oxygen generator 4. A lower packer 9 is suitably folded for each sub-container, its overlying walls 89 may be stapled or otherwise suitably attached together for added strength, and it is inserted in the respective sub-container. (Alternatively, if lower tabs 126 are provided, they are pushed inwardly.) The bottoms of the sub-containers 3 are closed, and the tamper proof seals or labels 134 are then applied over the sub-container bottoms. Each of the generators is placed in a sub-container with the bottom end cap 5 resting on the lower packer wall 82 (or alternatively on the tabs 126). An upper packer member 7 is selected from the set of upper packer members 7A, 7B, and 7C,suitably folded, and inserted into each sub-container so that its bottom wall 50 engages the upper end cap 5 and the side walls 52 extend upwardly therefrom. The upper sub-container lids are then closed, and the tamper proof seals or labels 136 then applied over the sub-container tops. The liner 90 is inserted in the container 1. The packed and closed sub-containers 5 are then inserted adjacent each other in the container 1 so that the container is filled fully with the capacity of sub-containers. It is not necessary that all of the sub-containers contain generators, but the box should be filled to capacity with the sub-containers (whether filled or unfilled). Suitable cushioning material may be placed on the container floor 14 under the sub-containers 3 and/or may be placed over the sub-containers. The container 1 is then closed and tape 70 applied along the adjacent edges 25 of the outer two closure flaps 15 and onto the end walls 13 at the ends thereof or otherwise as suitable to close the top of the container. These outer closure flaps 15 are also taped with tape 72 along their side edges 23 to the end walls 13 respectively but leaving gaps 74 to serve as routes for generated heat and oxygen to escape from the container 1 if generated gas pressure starts building up in the container. The bottom of the container 1 is similarly taped before the liner 90 is inserted. As previously discussed, the top and bottom of the container may alternatively be closed by applying glue or staples or using other suitable means provided a complete gas-tight seal is not achieved. The packed container is then ready for shipment.

In the event during shipment of a premature ignition of an oxygen generator, the corrugated board packing materials are not in contact with the hot generator and are insulated therefrom by the protective end caps, and heat and oxygen are allowed to freely flow over the entire lengths of the sub-containers and through the holes 8 and 6 out of the sub-container and into the other sub-containers through holes 8 and 6 aligned therewith so that the heat and oxygen may be safely dispersed throughout the shipping container.

Referring to FIGS. 15 to 19, there is illustrated generally at 200 an alternative embodiment of packaging for a single oxygen generator (contained within sub-container 3) and its accompanying storage container or carrying case 201 in which it is contained during normal use. The storage container 201 is contained within a cardboard box, illustrated at 202. The packaging 200 includes a shipping container 204, which may be similar to shipping container 1, but sized differently, which has two side flaps 206 and two end flaps 208 for opening and closing the container 204. The cardboard box 202 is received in one side of the shipping container 204.

The holes 8 of a sub-container 3, when only a single sub-container is being packaged, of course do not line up with holes of other sub-containers for discharge of heat and oxygen into the spaces provided by other sub-containers for dissipation thereof. Yet the heat and oxygen must still be dissipated in the event of initiation of the single oxygen generator in order to avoid local concentrations of high heat and high oxygen. In order to provide for dissipation thereof, in accordance with this alternative embodiment of the present invention, a suitably sized air gap or empty space, illustrated at 210, is provided all the way around the sub-container 3. The width, illustrated at 212, of this air gap 210 may, for example, be about 1 inch.

In order to provide air gap 210 as well as to provide vibrational and shock resistance, in accordance with this alternative embodiment of the present invention, a pair of identical sleeves 214, composed of cardboard or other suitable material, cap the ends of the sub-container 3. A suitable folded liner 216, composed of cardboard or other suitable material, is wrapped about the cap sleeves 214 over the height of the sub-container 3, leaving the air gap 210, and the assembly then inserted into the other side of the container 204, adjacent and snug with the box 202. Since the sub-container 3 is, as illustrated, shorter than box 202, a packer member 218, composed of cardboard or other suitable material, is inserted to lie on top of the upper sleeve cap 214 with a pair of legs 220 extending upwardly to the closure flaps 206 and 208. Since the box 202 is narrower than the container 204, a packer member 222, also composed of cardboard or other suitable material, is inserted to lie alongside the box 202 with legs 224 extending to a side of container 204. Thus, when the container 204 is closed, as illustrated in FIG. 17, the contents thereof are packed snugly while leaving the void 210 around the sub-container 3 for dissipation of heat and oxygen in the event of oxygen generator initiation.

Figure 17:
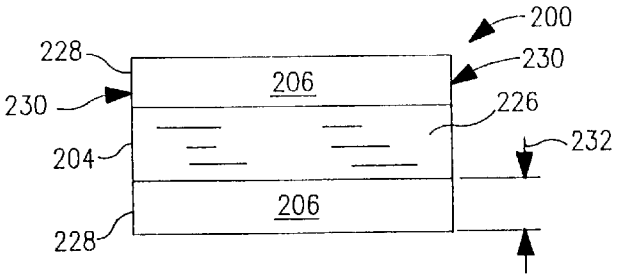
FIG. 17 is a plan view of the container of FIG. 15, closed and taped for shipment.

As illustrated in FIG. 17, after the end flaps 208 then side flaps 206 are folded to close the container 204, a strip, illustrated at 226, of suitable tape is applied along the edges of flaps 206 and onto the container ends to prepare the container 204 for shipment. Similarly as discussed with respect to container 1, the closure flaps are not completely taped to the end walls along their side edges 228 to thereby leave relief passages, as illustrated at 230, over distances, illustrated at 232, of, for example, about 1 inch minimum for generated heat and oxygen to escape from the container 204 when the generated gas pressure begins to build up within the container. The tape 226 may, for example, be non-asphaltic reinforced gum tape. As discussed for container 1, other suitable means may be used instead of the tape 226 to close the container 204 provided a complete gas-tight seal is not achieved.

Figure 18:
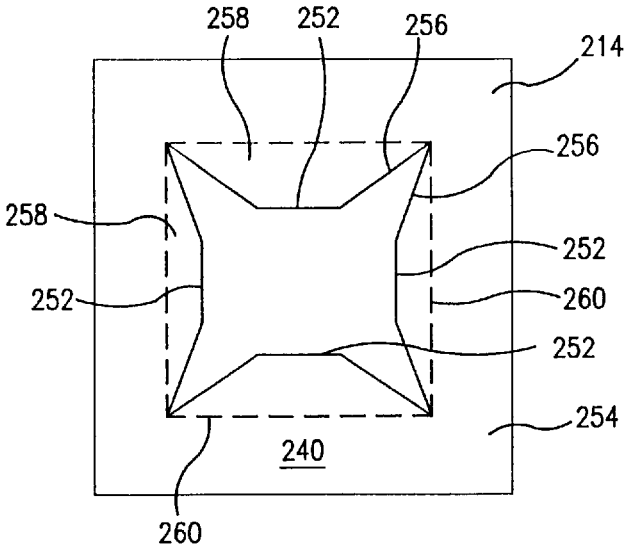
FIG. 18 is a plan view of sleeve for receiving the oxygen generator for the container of FIG. 15.
Figure 19:
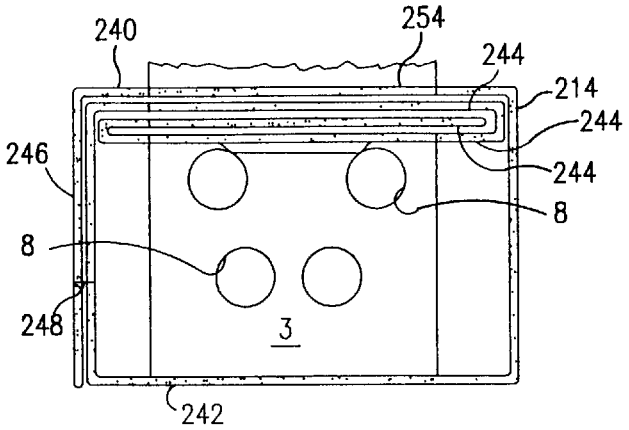
FIG. 19 is a side view of the sleeve with the oxygen generator, illustrated partially, received therein.

As best seen in FIGS. 18 and 19, each sleeve cap 214 is composed of a single length of cardboard, or other suitable material, which is folded into a shape which is generally rectangular in cross-section with open ends. The sleeve 214 has an inner side 240, which faces the interior of the container 204, and an outer side 242, which faces either the upper or the bottom wall of the container 204. As seen in FIG. 19, the cardboard is folded to provide additional strengthening layers, illustrated at 244, in the inner side 240. The folding terminates with an additional layer 246 along one side, and the two layers along that side stapled by means of a staple, illustrated at 248, centrally between the ends of the sleeve 214, or the two layers may be otherwise suitably attached.

Figure 16:
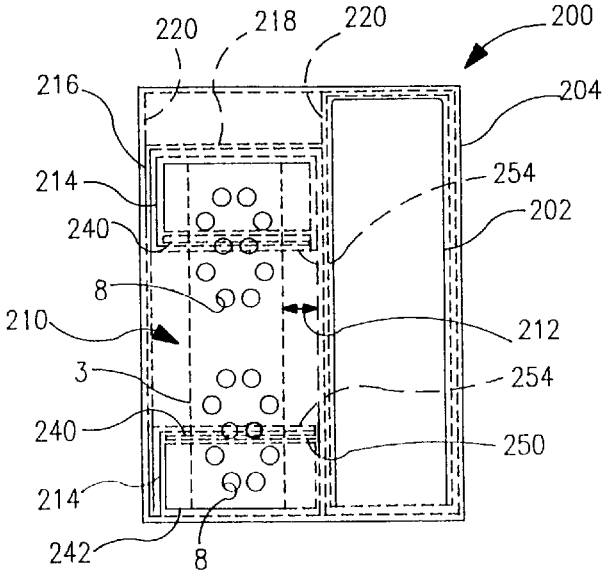
FIG. 16 is a side view of the container of FIG. 15 with parts broken away for ease of illustration and illustrating the arrangement of packaging therein.

Cut-outs, illustrated at 250 in FIG. 16, are provided through the inner layers 244 of the inner sleeve side 240 and sized to snugly receive the sub-container 3. A smaller (generally square) cut-out, defined by edges 252, is provided in the outer layer 254 of the inner sleeve side 240, and diagonal slits, defined by edges 256, are cut outwardly from the corners of the cut-out defined by edges 252 to form tabs 258. The tabs 258 are folded, along fold lines illustrated at 260, inwardly of the sleeve 214 to lie in the inner layer cut-outs 250 alongside the edges thereof to provide an opening for receiving the sub-container 3 and are biased to exert a force, like a spring, thereon to hold the sleeve securely on the sub-container 3 during packing. As seen in FIG. 19, the sub-container 3 is inserted between the tabs 258 and through the cut-outs 250 until its end rests on the outer side 242 of the sleeve 214. It should be understood that other suitable means may be provided for providing the space 210 for dissipation of heat and oxygen in the event of oxygen generator initiation.

It should be understood that the packaging 200 may be suitably modified, in accordance with principles commonly known to those of ordinary skill in the art to which this invention pertains, to contain other components, such as a drop-out box, to be shipped with the oxygen generator or to contain no additional components, in which event the size of the container 204 would be reduced so as to snugly receive the liner 216 and its height reduced so that the packer 218 is not required.

Figure 20:
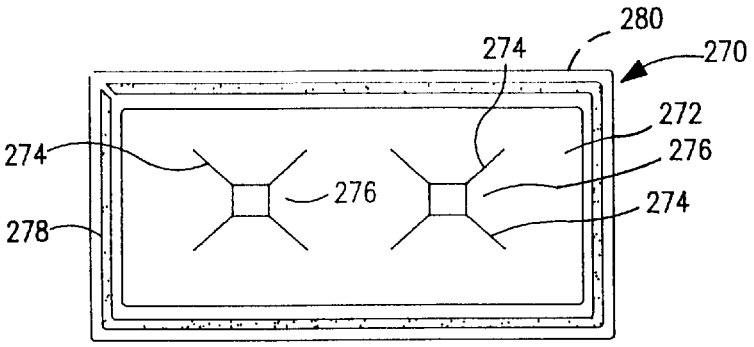
FIG. 20 is a plan view of a sleeve in accordance with an alternative embodiment of the present invention.

It should also be understood that more than one oxygen generator may be packaged in accordance with the principles of the embodiment of FIGS. 15 to 19, using principles commonly known to those of ordinary skill in the art to which this invention pertains. Thus, referring to FIG. 20, there is illustrated generally at 270 packaging for such an alternative embodiment. The packaging 270 includes a pair of sleeve caps 272, similar to sleeve caps 214 except sleeve caps 272 are longer and contain two cut-out openings, illustrated by slits 274 with tabs 276, for receiving two sub-containers 3 respectively instead of a single sub-container. The cut-outs are suitably spaced so that a suitable air gap or space, similar to space 210, surrounds each of the sub-containers. The sleeves 272 are enclosed over the sub-container height by a liner 278, similar to liner 216, and the assembly inserted snugly in a container, illustrated in phantom lines at 280, which is similar to container 204 and sized to snugly receive the liner 216 with the sleeves 270 contained therein. Thus, packaging 270 is not constructed for containing any accessory components but, if desired, may be sized and constructed to do so and/or to contain a greater number of sub-containers, in accordance with principles commonly known to one of ordinary skill in the art to which this invention pertains.

It should be understood that, while the present invention has been described in detail herein, the invention can be embodied otherwise without departing from the principles thereof, and such other embodiments are meant to come within the scope of the present invention as defined by the appended claims.

What is claimed is:

1. Packaging for transporting at least one gas generator, the packaging comprising means defining at least one sub-compartment for receiving the at least one gas generator, said sub-compartment means receivable in a container and having a plurality of walls including side walls, means for separating and insulating the at least one gas generator from said walls, and means defining apertures in said side walls for passing heat and gas from said at least one sub-compartment for dissipation thereof.

2. Packaging according to claim 1 wherein said sub-compartment means comprises a plurality of individual sub-containers each having said side walls, the packaging further comprising a container, said sub-containers sized and shaped to snugly fit wall-to-wall within said container with others of said sub-containers and with said container, said apertures positioned on said sub-container side walls to allow flow of heat and gas from each of said sub-containers into adjacent ones of said sub-containers.

3. Packaging according to claim 2 wherein said sub-containers are substantially identical in size and shape, each said sub-container having four of said sub-container side walls, each of said sub-container side walls being rectangular and having a substantially identical pattern of said apertures, said pattern of apertures being arranged symmetrically to insure flow of heat and gas from said sub-containers no matter which of said end walls is disposed to the bottom of said container when said sub-containers are disposed within said container.

4. Packaging according to claim 1 wherein said sub-compartment means comprises at least one sub-container, the packaging further comprising a container for receiving said at least one sub-container, means for positioning said at least one sub-container within said container to define a space around said at least one sub-container for passage of heat and gas into the space from said at least one sub-container for dissipation thereof.

5. Packaging according to claim 4 wherein said positioning means comprises a pair of sleeves in which end portions of said at least one sub-container are receivable respectively, a liner for surrounding said sleeves over a height of said sub-container, and means for snugly securing the assembly of said liner and said sleeves and said sub-container in said container.

6. Packaging according to claim 1 wherein said sub-compartment means is composed of cardboard.

7. Packaging according to claim 1 wherein said separating and insulating means comprises a pair of end caps composed of insulative material for receiving end portions of the gas generator respectively and for engaging said sub-compartment side walls to thereby center the gas generator within said sub-compartment.

8. Packaging according to claim 7 wherein said sub-compartments are square-shaped in cross-section and said end caps are cylindrical-shaped to thereby provide passages between said end caps and said sub-compartment side walls for flow of heat and gas beyond said end caps.

9. Packaging according to claim 7 further comprising means for centering the gas generator along a sub-compartment length.

10. Packaging according to claim 9 wherein said centering means comprises a support member disposable between one of said end walls and said respective end cap.

11. Packaging according to claim 9 wherein said centering means comprises support tabs formed from said side walls to extend inwardly of said sub-compartment to engage said end caps respectively for support thereof.

12. A method for packaging at least one gas generator for transport thereof, the method comprising the steps of inserting the gas generator into a sub-compartment having apertures in side walls thereof for passage of heat and gas therethrough for dissipation thereof, separating and insulating the gas generator from the walls of the sub-compartment, inserting and securing the sub-compartment within a container, and closing the container.

13. A method according to claim 12 wherein the step of closing the container comprises securing closure flaps so as to allow passages for release of heat and gas from the container.

14. A method according to claim 12 wherein the sub-compartment is an individual sub-container, the method further comprising disposing a plurality of the individual sub-container to completely and snugly fill the container in a wall-to-wall relation with apertures in adjacent side walls of the sub-containers aligning to allow passage of heat and gas from one sub-container to other sub-containers.

15. A method according to claim 12 wherein the sub-compartment is an individual sub-container, the method further comprising positioning the individual sub-container to define a space around the sub-container for passage of heat and gas from the sub-container for dissipation thereof.

16. A method according to claim 12 further comprising selecting the container and sub-compartment means to both be composed of cardboard.

17. A method according to claim 12 wherein the step of separating and insulating comprises disposing end caps composed of insulative material on the gas generator ends respectively, the end caps being sized to engage the sub-compartment side walls.

18. A method according to claim 12 further comprising centering the gas generator along the sub-compartment length.

19. A method according to claim 18 wherein the step of centering comprises disposing a support member between one of the sub-compartment end walls and the respective end cap.

20. A method according to claim 18 wherein the step of centering comprises disposing the gas generator to be supportively engaged by tabs formed in side walls of the sub-compartment.

* * * * *